US010898741B2

(12) United States Patent
Giroux

(10) Patent No.: US 10,898,741 B2
(45) Date of Patent: Jan. 26, 2021

(54) SAFETY ANCHOR AND ROOF VENT

(71) Applicant: Michael Giroux, Astorville (CA)

(72) Inventor: Michael Giroux, Astorville (CA)

( * ) Notice: Subject to any disclaimer, the term of this patent is extended or adjusted under 35 U.S.C. 154(b) by 0 days.

(21) Appl. No.: 16/044,759

(22) Filed: Jul. 25, 2018

(65) Prior Publication Data

US 2019/0030380 A1 Jan. 31, 2019

(51) Int. Cl.

| | |
|---|---|
| ***A62B 35/00*** | (2006.01) |
| ***F24F 7/02*** | (2006.01) |
| ***E04D 13/12*** | (2006.01) |
| ***E04G 21/32*** | (2006.01) |

(52) U.S. Cl.

CPC ..... *A62B 35/0068* (2013.01); *E04D 13/12* (2013.01); *E04G 21/3214* (2013.01); *F24F 7/02* (2013.01)

(58) Field of Classification Search

CPC . A62B 35/0068; A62B 35/0037; E04D 13/12; E04G 21/3214; F24F 7/02

See application file for complete search history.

(56) References Cited

U.S. PATENT DOCUMENTS 2,692,548 A * 10/1954 Knorr ..... F24F 7/02 454/366
4,297,818 A * 11/1981 Anderson ..... F24F 7/02 454/366
5,054,576 A * 10/1991 Glynn ..... A62B 35/04 182/3
5,287,944 A * 2/1994 Woodyard ..... A62B 35/04 182/3
5,346,036 A * 9/1994 Arisman ..... A62B 35/04 182/3
5,595,260 A * 1/1997 Jalla ..... A62B 35/0068 182/3
5,632,678 A * 5/1997 Doelfel ..... E04D 13/17 454/366
5,727,646 A * 3/1998 Gray ..... E04D 15/00 182/3
5,730,407 A * 3/1998 Ostrobrod ..... A62B 35/0043 182/231
5,850,889 A * 12/1998 Rexroad ..... A62B 35/0043 182/3
6,668,509 B1 * 12/2003 Krebs ..... E04D 13/12 52/698
D646,553 S * 10/2011 Peng ..... D8/349
8,448,745 B2 * 5/2013 Crookston ..... E04G 21/3276 182/3
9,228,357 B1 * 1/2016 Varela ..... E04D 13/178
9,744,387 B1 * 8/2017 Hung ..... E04G 21/328
10,053,878 B2 * 8/2018 Allen ..... E04G 21/328
2001/0049261 A1 * 12/2001 McKee ..... F24F 13/084 454/367
2003/0051429 A1 * 3/2003 Hovenier ..... A62B 35/0068 52/651.1

(Continued)

*Primary Examiner* — Beth A Stephan

(74) *Attorney, Agent, or Firm* — Amardeep S. Grewal; Reed Smith LLP

(57) ABSTRACT

An anchor support and roof vent for a pitched roof, comprising a support member having a first end and a second end, the support member being sized so that the first end is fixable to a first roof truss and the second end is fixable to a second roof truss, an anchor line attachment fixable to the support member, and a roof vent cover attachable over the anchor support member.

6 Claims, 8 Drawing Sheets

(56) References Cited

U.S. PATENT DOCUMENTS

| | | | | |
|---|---|---|---|---|
| 2007/0144830 | A1* | 6/2007 | Mastenbroek | A62B 35/0056 182/3 |
| 2012/0222370 | A1* | 9/2012 | Crookston | E04G 21/3276 52/173.1 |
| 2013/0087669 | A1* | 4/2013 | Daddio | E04G 21/3276 248/237 |
| 2014/0065946 | A1* | 3/2014 | Tovmasyan | E04D 13/17 454/358 |
| 2014/0123568 | A1* | 5/2014 | Nurdogan | E04D 1/30 52/57 |
| 2015/0075107 | A1* | 3/2015 | Wert | E04B 7/022 52/643 |
| 2015/0107184 | A1* | 4/2015 | Nichols, Jr. | E04G 21/3276 52/710 |
| 2017/0157438 | A1* | 6/2017 | Sargent | E04G 21/328 |
| 2017/0361135 | A1* | 12/2017 | Crookston | A62B 35/0068 |

* cited by examiner

SAFETY ANCHOR AND ROOF VENT

FIELD OF THE INVENTION

This invention relates to a safety anchor and roof vent. More particularly, this invention relates to a safety anchor device that enables a worker to attach a safety anchor line to the device, for example when working on the roof, and selectively acts as a roof vent that enables the venting of air from an attic space of a building.

BACKGROUND OF THE INVENTION

When workers are working on the roofs of buildings and in particular, residential and commercial buildings which have pitched roofs, they typically use an anchor line and harness system for safety in the event of a slip or fall. These anchor lines must be secured at an end opposite the worker such that the line will withstand the forces which may be applied to them should they be required to suddenly support the worker if he or she slips and/or falls.

In the past, workers such as roofers have tied safety lines to objects such as trees or cars on an opposite side of a building on which they are working. This set up is dangerous since the safety lines can rub across the ridge of the roof, which is usually shingled, and the safety line can become frayed and brittle. Further, the object which the safety line is attached to may not be able to support the requisite force applied if a worker falls. This presents an obvious safety hazard since the safety line may break and the worker will fall and become injured.

SUMMARY OF THE INVENTION

The Applicant has appreciated that there is a need for a safety anchor that can be permanently mounted to the roof of a building, in particular a pitched roof, so that re-surfacing the roof can be more efficiently and safely completed. Further, the Applicant has appreciated that it would be advantageous to have a roof vent cover the safety anchor, since the access to the safety anchor needs to be covered for weatherproofing and also aesthetic reasons.

It is therefore an object of this invention to provide a safety anchor that can be permanently mounted to the roof of a building and covered by a roof vent.

In one aspect, the present invention resides in an anchor support and roof vent for a pitched roof, comprising: a support member having a first end and a second end, the support member being sized so that the first end is fixable to a first roof truss and the second end is fixable to a second roof truss, an anchor line attachment fixable to the support member, and a roof vent cover attachable over the anchor support member.

Preferably, a first bracket is provided to fix the first end to the first roof truss, and a second bracket is provided to fix the second end to the second roof truss.

Preferably, the anchor line attachment comprises a plate and a D-ring pivotally attached thereto.

Preferably, the plate is quadrangular and has apertures in each corner, and the plate is attachable to the support member by u-shaped bolts with threaded ends, the u-shaped bolts being fixed around the support member and threaded nuts fixed to the threaded ends of the u-shaped bolts.

Still preferably, wherein the roof vent cover comprises a roof vent plate and a roof vent hood hingedly attached thereto.

Preferably, the roof vent plate has an aperture and a ring fixed thereto, the aperture being positionable over the anchor line attachment such that a safety line can be attached to the anchor line attachment through the aperture.

Preferably, at least one latch is fixed to the roof vent hood to fix the roof vent hood to the roof vent plate.

Further and other features of the invention will be apparent to those skilled in the art from the following detailed description of the embodiments thereof.

BRIEF DESCRIPTION OF THE DRAWINGS

Reference may now be had to the following detailed description taken together with the accompanying drawings in which.

DETAILED DESCRIPTION OF THE PREFERRED EMBODIMENTS

Figure 1:
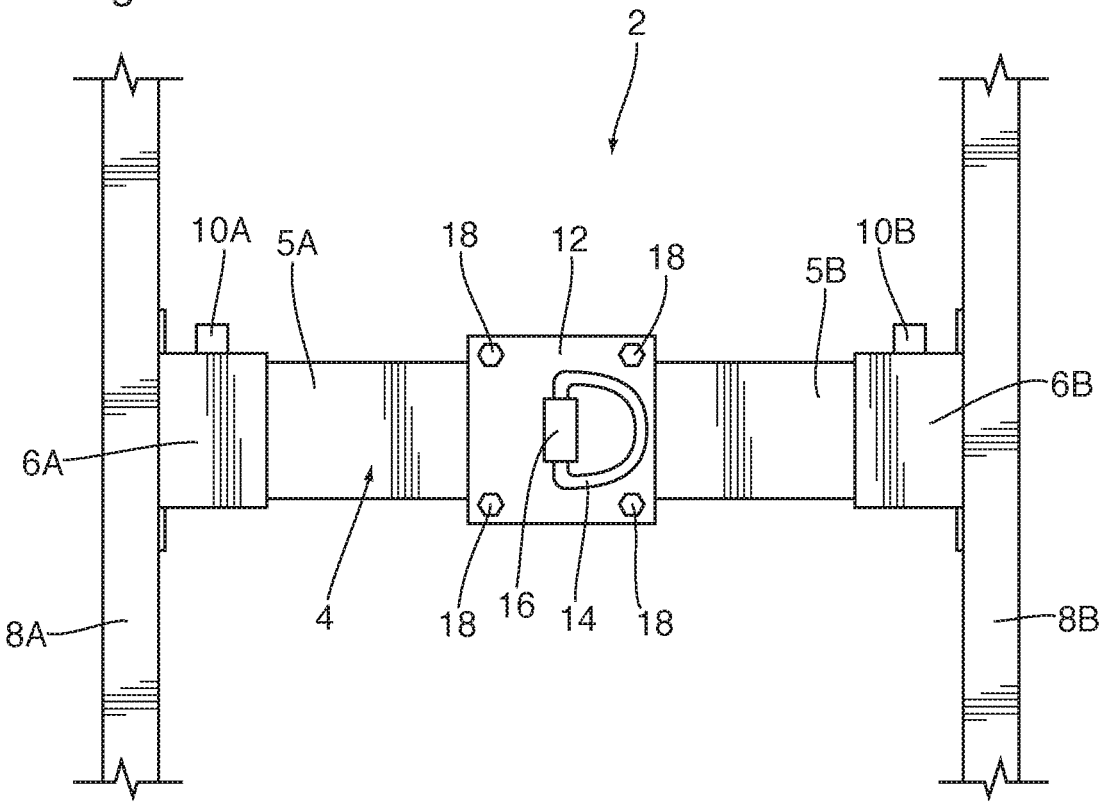
FIG. 1 shows a safety anchor apparatus, without the roof vent, from a top view.

FIG. 1 shows a safety anchor apparatus 2 in accordance with one embodiment of the present invention. The safety anchor apparatus 2 is shown in top view. The safety anchor apparatus 2 has a support member 4 which has a first end 5A and a second end 5B. The first end 5A is supported by a first bracket 6A, and the second end 5B is supported by a second bracket 6B.

In one preferred embodiment, the support member 4 is a 2 inch by 2 inch square tube made of steel that is 3/16 inches thick. It is to be appreciated that the support member 4 could be sized and formed of appropriate material to provide enough rigidity and strength to withstand forces that would be applied if a worker slipped or fell and a force was exerted on the support member, plus a factor of safety. As shown, the first bracket 6A and second bracket 6B are square tubes sized to accept the respective first end 5A and second end 5B.

Figure 2:
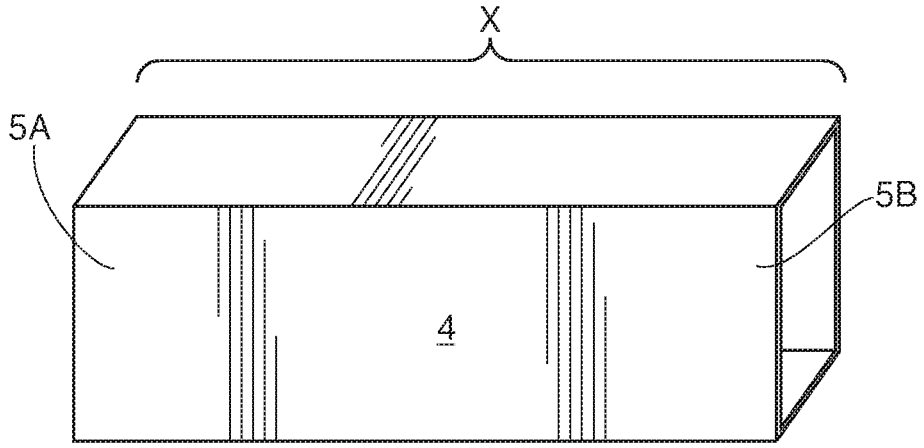
FIG. 2 shows a support member of FIG. 1 in perspective view.

As shown in FIG. 2, the support member 4 is a square steel beam that can be sized at a length X. Preferably, length X is twenty-one and a half (21½) inches for trusses constructed such that the centres of the trusses are separated by 24 inches, and thirteen and a half (13½) inches for trusses constructed such that the centres of the trusses are separated by sixteen inches. The support member 4 has a first end 5A and a second end 5B. The first end 5A is fitted into the first bracket 6A and the second end 5B is fitted into the second bracket 6B.

As shown in FIG. 1, the first bracket 6A is fixed to a first roof truss 8A, and the second bracket 6B is fixed to a second roof truss 8B. Preferably the first and second brackets 6A and 6B are fixed to the first and second roof trusses 8A and 8B with suitable mechanical fasteners such as screws.

Figure 3:
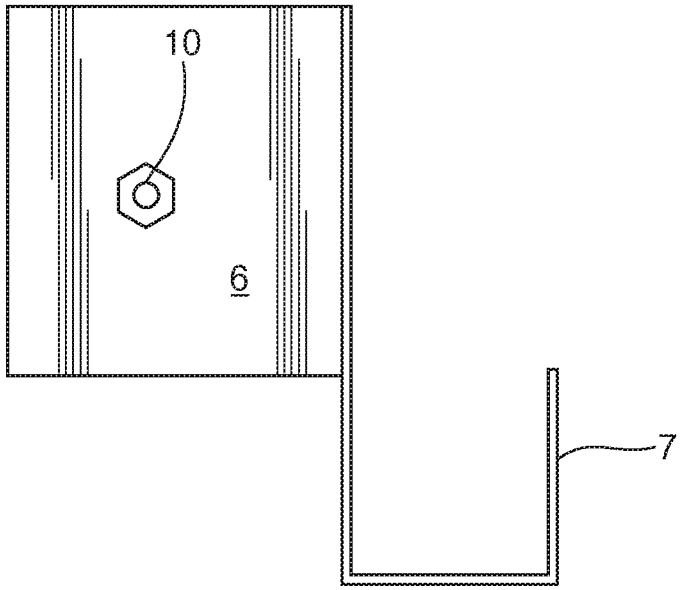
FIG. 3 shows a bracket to fix the support member to a roof truss from FIG. 1.
Figure 4:
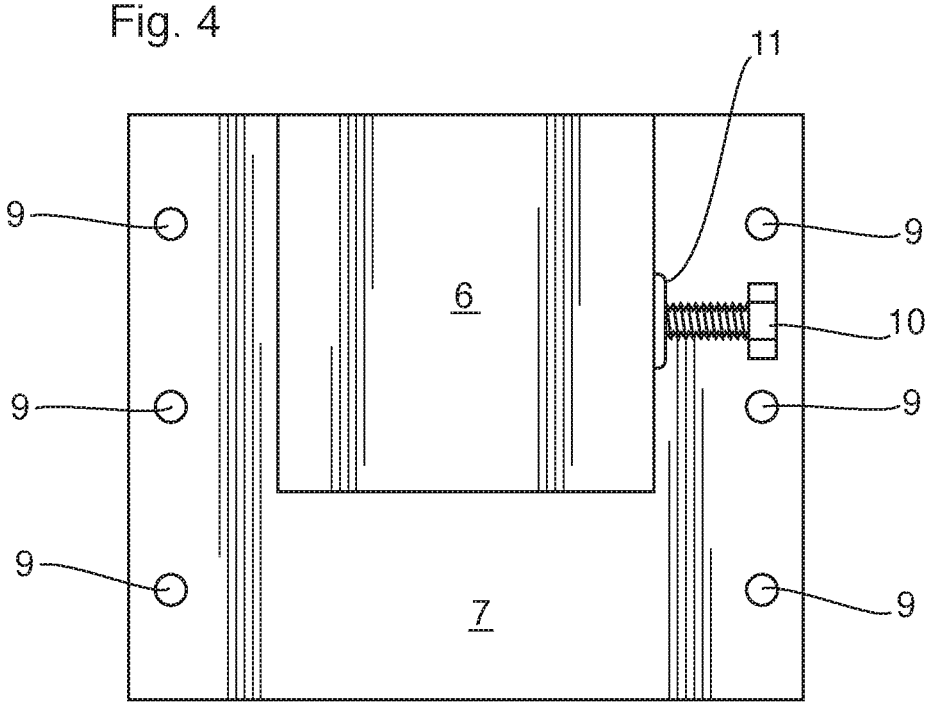
FIG. 4 shows the bracket from FIG. 3 in front view.

FIG. 3 shows the bracket 6 which is used to fix the support member 4 (not shown) to a roof truss (also not shown). The bracket 6 has a J-shaped flange 7 which is sized so that the roof truss (not shown) fits in the interior space in the J-shaped flange 7. As shown in FIG. 4, the J-shaped flange 7 has holes 9 which are sized so that suitable mechanical fasteners such as screws can be fixed therein and secured into the roof truss. Preferably, the J-shaped flange 7 is made of metal ⅛ inch thick and is 4 inches wide and 3.5 inches high if the truss being used is 2 inches by 4 inches, and 5.5 inches in height if a 2 inch by 6 inch truss is being used. Further, a bolt 10 can be secured into a threaded aperture 11 in the bracket 6 to hold the support member 4 in place. The bolt 10 can be installed on either side of the bracket 6. Preferably, the bolt 10 is 1.25 inches in diameter.

Figure 5:
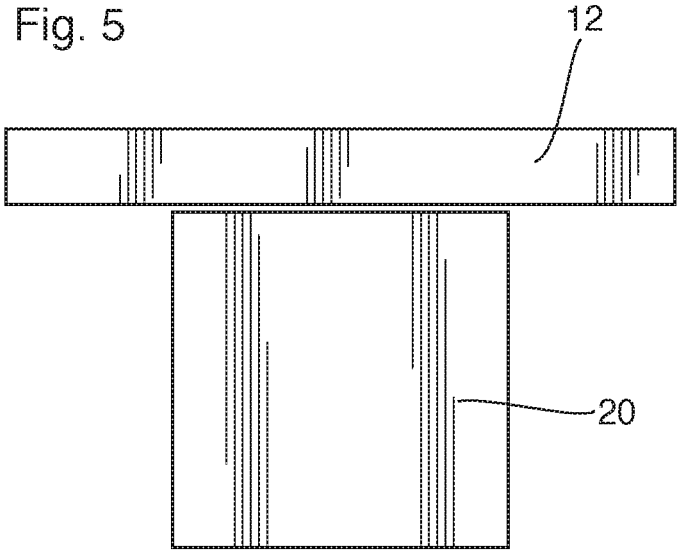
FIG. 5 shows an anchor line attachment plate (without a D-ring attached) from FIG. 1 in side view.
Figure 6:
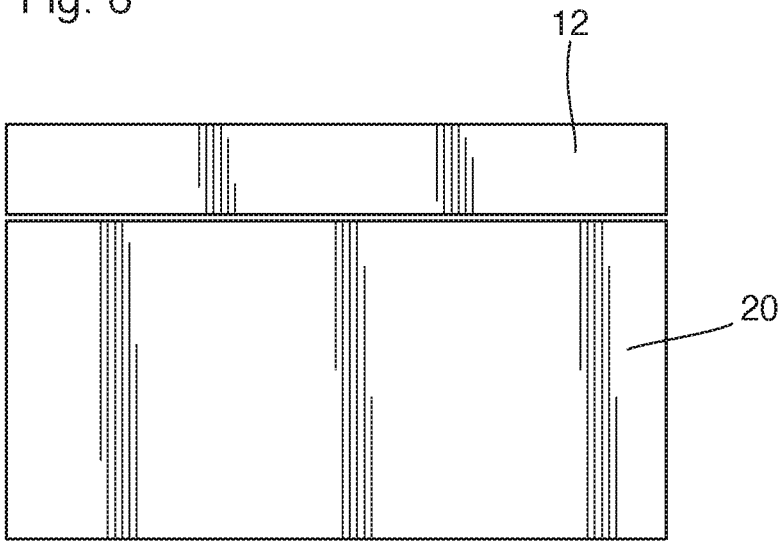
FIG. 6 shows the anchor line attachment plate from FIG. 5 in side view.

FIG. 5 shows an anchor line attachment plate 12 (without a D-ring attached) from FIG. 1 in side view. FIG. 6 shows the anchor line attachment plate 12 of FIG. 5 from a side view. Preferably, the attachment plate 12 is a ⅜ inch thick metal plate. As shown, a spacer 20 is provided to adjust the height of the plate 12 when fixed to the support member 4. Preferably, the spacer 20 is 2 inch by 2 inch square tubing.

Figure 7:
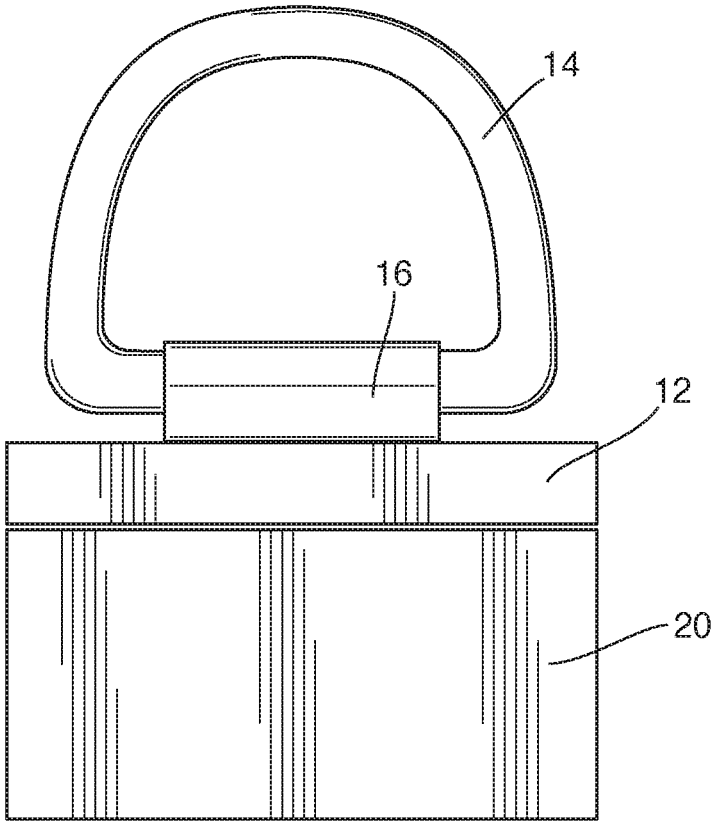
FIG. 7 shows the anchor line attachment plate of FIG. 5 with a D-ring attached.

FIG. 7 shows the anchor line attachment plate 12 with a D-ring 14 attached from FIG. 1 in side view. The D-ring 14 is pivotally attached to the plate 12 by a semi-circular tube section 16 that is fixed to the plate 12. The D-ring 14 must be capable of withstanding forces that would be applied if a worker slipped or fell and a force was exerted on the D-ring 14, plus a factor of safety, for example being able to withstand a force of 4000 lbs. Preferably, the D-ring 14 is ⅜ inch diameter metal.

Figure 8:
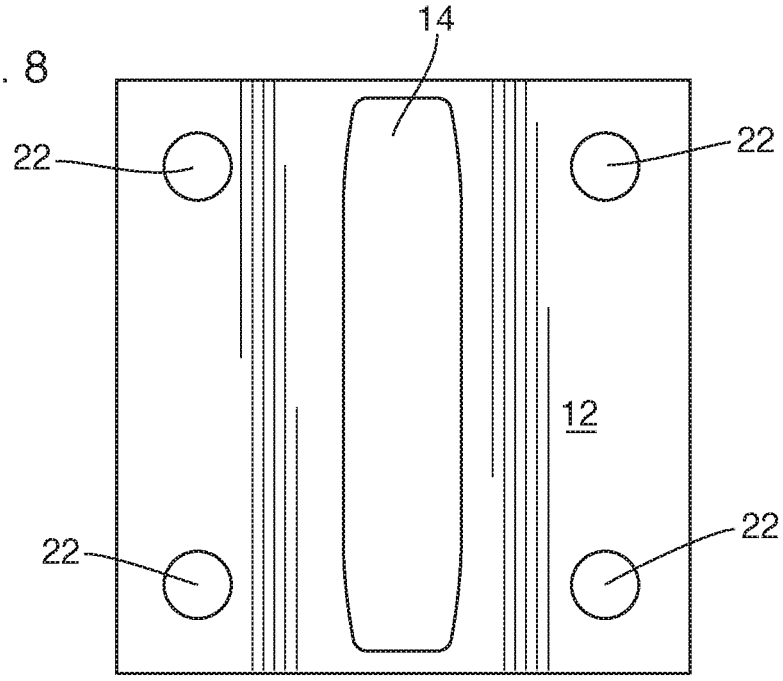
FIG. 8 shows the anchor line attachment plate of FIG. 7 from a top view.
Figure 9:
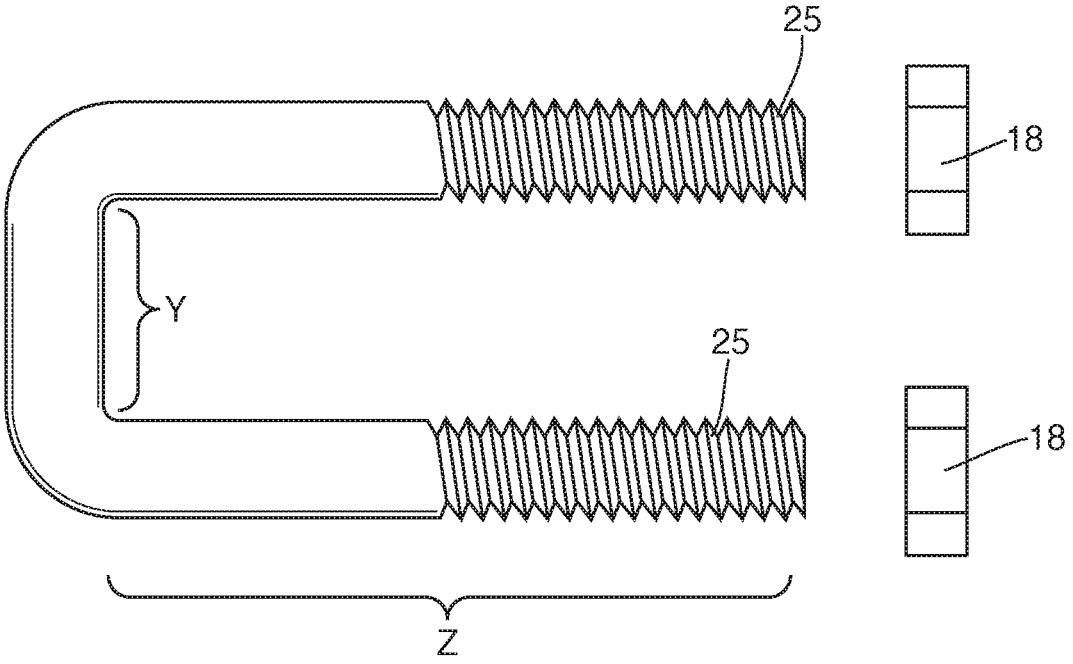
FIG. 9 shows a U-bolt.

FIG. 8 shows the anchor line attachment plate 12 of FIG. 6 from a top view. The attachment plate 12 is square and has apertures 22 in each corner. As shown in FIG. 9, a U-shaped bolt 24 is used to fix the plate 12 to the support member 4. The U-shaped bolt is positioned with the threaded prongs 25 fitted through the apertures 22 and bolts 18 are fastened to the threaded prongs 25. Preferably, the U-shaped bolt 24 is made of ⅜ inch metal and has a middle span Y of 2⅛ inches, and a length Z of 5 inches.

Figure 10:
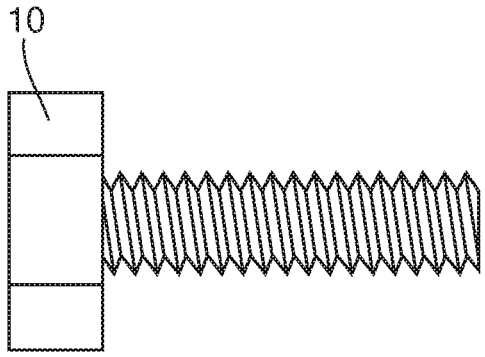
FIG. 10 shows a bolt.

FIG. 10 shows a bolt 10 for securing the support member 4 to the brackets 6A and 6B, as shown in FIG. 1, FIG. 3, and FIG. 4.

Figure 11:
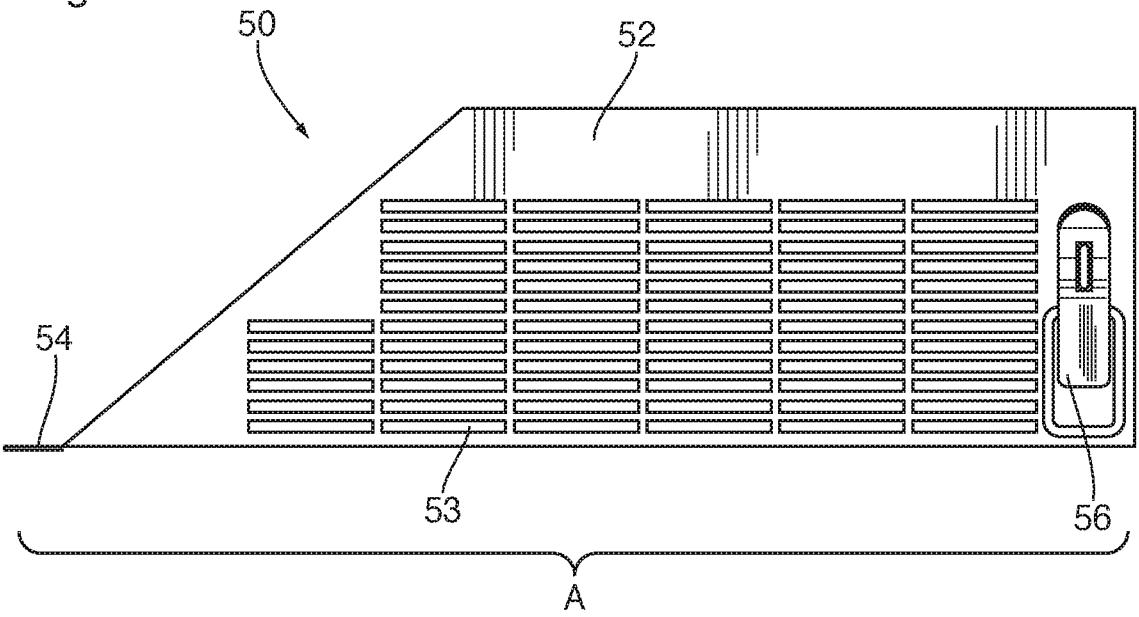
FIG. 11 shows a roof vent hood from a side view.

FIG. 11 shows a roof vent cover 50 from a side view. The roof vent cover 50 can be made from metal, aluminum, or plastic. The roof vent cover 50 has a roof vent hood 52 with a plurality of ventilation slots 53. The ventilation slots 53 permit hot air to exit from the attic of a dwelling and provide ventilation thereto. The roof vent cover 50 also has hinge top plates 54 fixed at a top end. Latches 56 are fixed at a bottom end. Preferably, the roof vent cover 50 has a length A of 16 inches and a height B of 5 inches at a bottom end.

Figure 12:
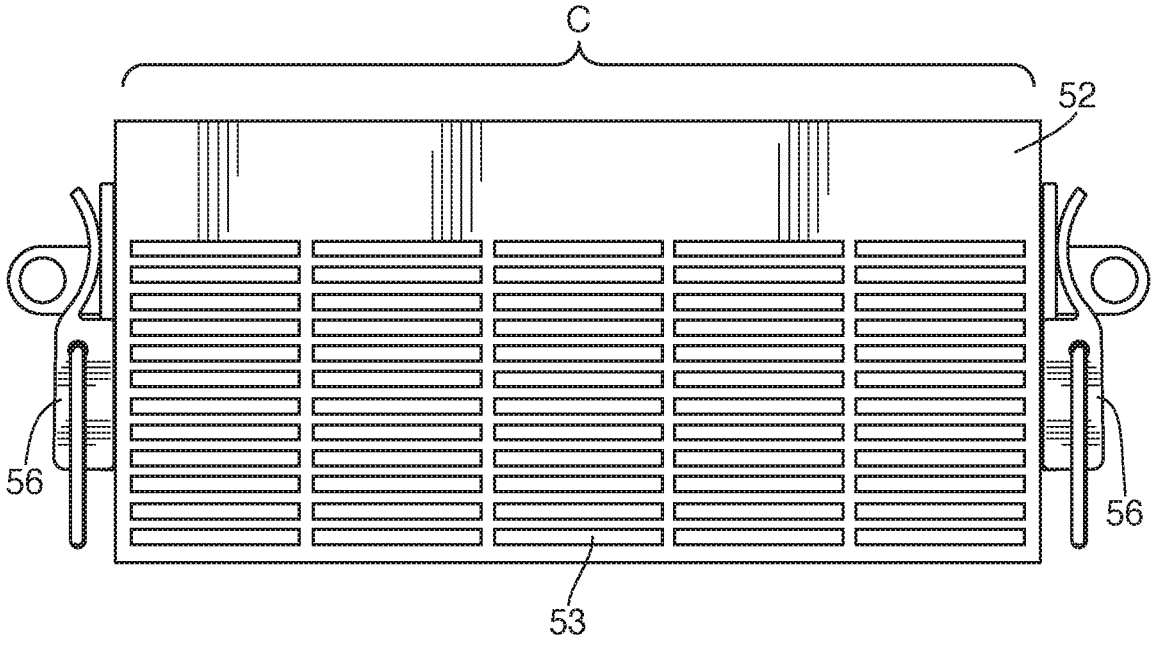
FIG. 12 shows the roof vent hood from FIG. 11 from an end view.

FIG. 12 shows the roof vent hood 52 from FIG. 11 from an end view. Preferably, the roof vent hood 52 has a width C of 12 inches.

Figure 13:
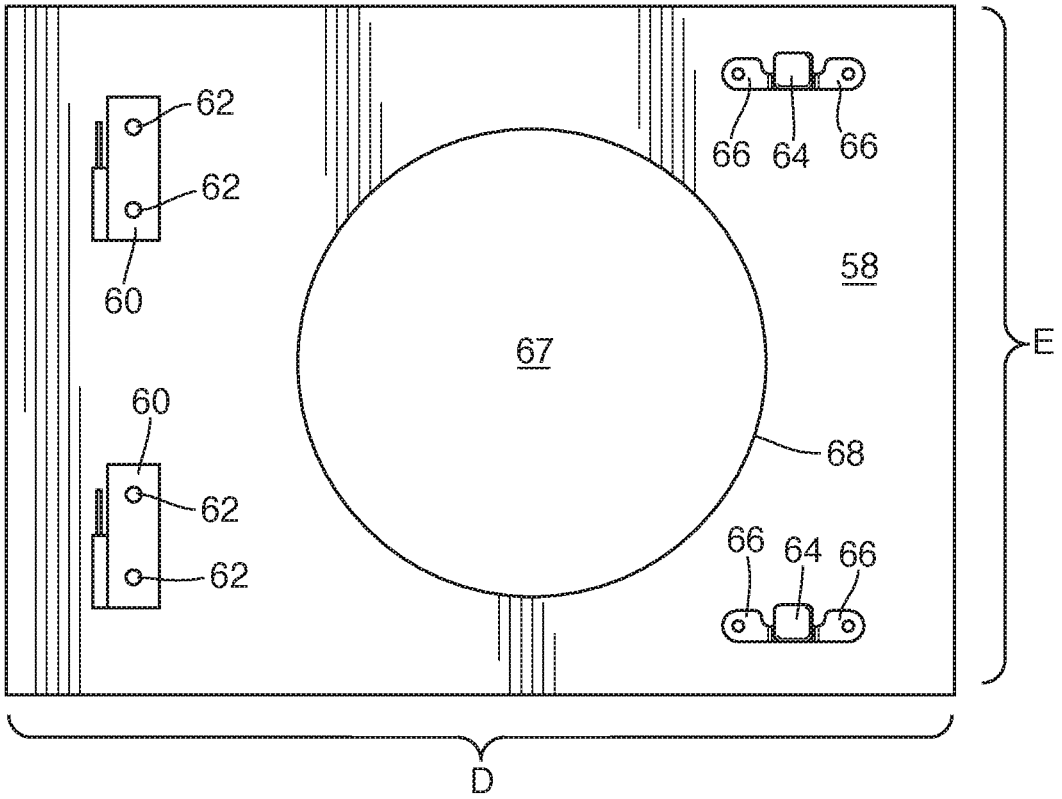
FIG. 13 shows a roof vent bottom plate from top view.

FIG. 13 shows a roof vent bottom plate 58 from top view. The roof vent bottom plate has hinge bottom plates 60 fixed to a top end. The hinge bottom plates 60 are fixed by spot welds, although it is appreciate that they could be fixed by other means that provides sufficient securing strength. The hinge plates 60 have hinge pins 63 which mate with an aperture in the hinge top plates so that the hinge bottom plates 60 can be hingedly fixed to the hinge top plates 54, and the roof vent hood 52 is thereby hingedly attached to the roof vent bottom plate 58. Preferably, the hinges and latches are made of metal such as aluminum and are spot welded to the bottom plate 58. In another embodiment, the roof vent cover 50 is made from plastic and the hinges and latches are also molded from plastic. In a preferred embodiment, the bottom plate 58 has a length D of 22 inches and a width E of 18 inches.

Latch catches 64 are fixed to the bottom end of the roof vent bottom plate. The latch catches 64 are fixed by spot welds 66. The latches 56 on the roof vent hood 53 can secure to the latch catches 64 to secure the roof vent hood 52 to the roof vent bottom plate 58.

Also as shown, the roof vent bottom plate 58 has an aperture and a ring 68 is provided therearound. The aperture 67 is positionable overtop of the D-Ring 14 so that when the roof vent hood 52 is in an open position, a safety line can be attached to the D-Ring 14.

Figure 14:
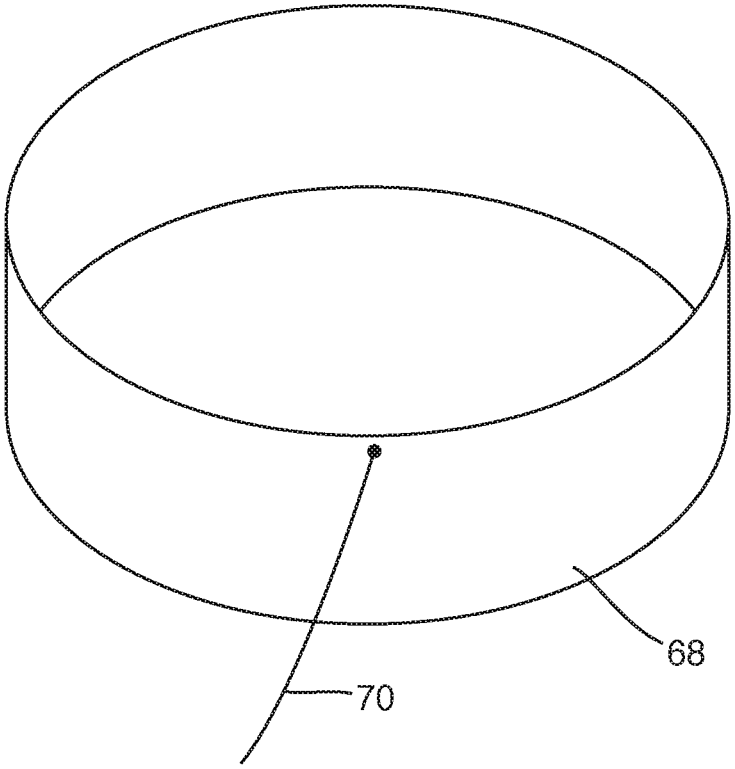
FIG. 14 shows the ring on the roof vent bottom plate in perspective view.

FIG. 14 shows the ring 68 on the roof vent bottom plate 58 in perspective view. Preferably, the ring 68 is three inches in height. Also as shown, a safety cable 70 is attached to the ring 68. is attached between the ring 68 and the roof vent hood 52 to prevent the roof vent hood 52 from falling in the event that the bottom hinges 60 are unsecured from the top hinges 54. Preferably, the safety cable 70 is a twenty inch long aircraft cable one-sixteenth of an inch in diameter.

Figure 15:
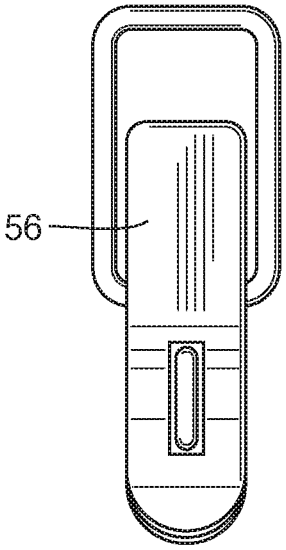
FIG. 15 shows a latch from the roof vent hood in FIG. 1 from a front view.
Figure 16:
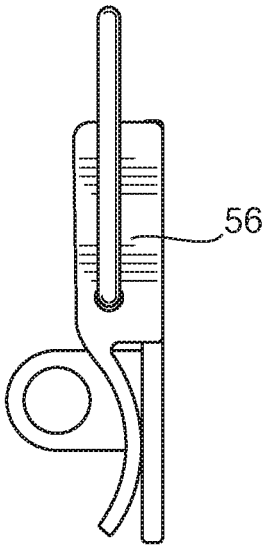
FIG. 16 shows a latch from the roof vent hood in FIG. 11 from a side view.

FIGS. 15 and 16 show the latch 56 used to connect the roof vent hood 52 to the latch catches 64 on the roof vent bottom plate 58. FIG. 15 shows the latch 56 from a front view. FIG. 16 shows the latch 56 from a side view.

Figure 17:
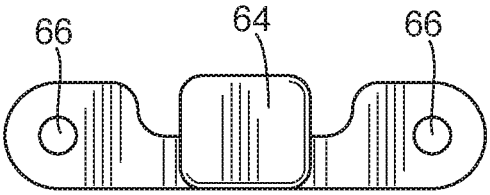
FIG. 17 shows a latch catch from the roof vent bottom plate in FIG. 13 from a front view.
Figure 18:
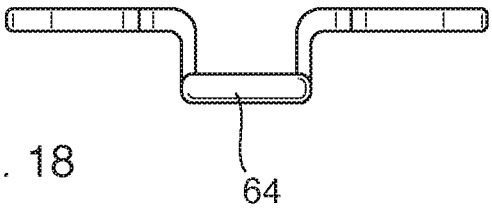
FIG. 18 shows a latch catch from the roof vent bottom plate in FIG. 13 from a side view.

FIGS. 17 and 18 show the latch catches 64 which are fixable to the roof vent bottom plate 58. FIG. 17 shows the latch catch 64 from a front view. FIG. 18 shows the latch catch 64 from a side view.

Although this disclosure has described and illustrated certain preferred embodiments of the invention, it is also to be understood that the invention is not restricted to these particular embodiments rather, the invention includes all embodiments which are functional, or mechanical equivalents of the specific embodiments and features that have been described and illustrated herein.

It will be understood that, although various features of the invention have been described with respect to one or another of the embodiments of the invention, the various features and embodiments of the invention may be combined or used in conjunction with other features and embodiments of the invention as described and illustrated herein.

The embodiments of the invention in which an exclusive property or privilege is claimed is defined as follows:

1. An anchor support and roof vent system for a pitched roof, comprising:

a support member having a first end and a second end, the support member being sized so that the first end is fixable to a first roof truss and the second end is fixable to a second roof truss, an anchor line attachment fixable to the support member, and a roof vent cover attachable over the support member, wherein the roof vent cover comprises a roof vent plate and a roof vent hood hingedly attached thereto and wherein the roof vent plate has an aperture and a ring fixed thereto, the aperture being positionable over the anchor line attachment such that a safety line can be attached to the anchor line attachment through the aperture.

2. An anchor support and roof vent system for a pitched roof, comprising:

a support member having a first end and a second end, the support member being sized so that the first end is fixable to a first roof truss and the second end is fixable to a second roof truss, an anchor line attachment fixable to the support member, wherein the anchor line attachment comprises a plate and a D-ring pivotally attached thereto, wherein the plate is quadrangular and has apertures in each corner, and the plate is attachable to the support member by u-shaped bolts with threaded ends, the u-shaped bolts being fixed around the support member and threaded nuts fixed to the threaded ends of the u-shaped bolts; and a roof vent cover attachable over the support member.

3. The anchor support and roof vent system of claim 2, wherein the roof vent cover comprises a roof vent plate and a roof vent hood hingedly attached thereto.

4. The anchor support and roof vent system of claim 3, wherein the roof vent plate has an aperture and a ring fixed thereto, the aperture being positionable over the anchor line attachment such that a safety line can be attached to the anchor line attachment through the aperture.

5. The anchor support and roof vent system of claim 3, wherein at least one latch is fixed to the roof vent hood to fix the roof vent hood to the roof vent plate.

6. An anchor support and roof vent system for a pitched roof, comprising:

a support member having a first end and a second end, the support member being sized so that the first end is fixable to a first roof truss and the second end is fixable to a second roof truss, an anchor line attachment fixable to the support member, wherein the anchor line attachment comprises a plate and a D-ring pivotally attached thereto, wherein the plate is attachable to the support member by at least one threaded fastener; and a roof vent cover attachable over the support member, wherein the roof vent cover comprises a roof vent plate and a roof vent hood hingedly attached thereto and wherein the roof vent plate has an aperture and a ring fixed thereto, the aperture being positionable over the anchor line attachment such that a safety line can be attached to the anchor line attachment through the aperture.

* * * * *